US007835539B2

(12) United States Patent
Ohashi

(10) Patent No.: US 7,835,539 B2
(45) Date of Patent: Nov. 16, 2010

(54) ELECTROACOUSTIC TRANSDUCER USING DIAPHRAGM AND METHOD FOR PRODUCING DIAPHRAGM

(75) Inventor: Yoshio Ohashi, Kanagawa (JP)

(73) Assignee: Sony Corporation, Tokyo (JP)

( * ) Notice: Subject to any disclaimer, the term of this patent is extended or adjusted under 35 U.S.C. 154(b) by 1159 days.

(21) Appl. No.: 11/485,967

(22) Filed: Jul. 14, 2006

(65) Prior Publication Data

US 2007/0019830 A1 Jan. 25, 2007

(30) Foreign Application Priority Data

Jul. 20, 2005 (JP) ..... 2005-210251

(51) Int. Cl.
*H04R 25/00* (2006.01)

(52) U.S. Cl. ..... 381/430; 381/190

(58) Field of Classification Search ..... 381/114, 381/173, 190, 430; 310/324, 328, 334, 800; 29/25.35

See application file for complete search history.

(56) References Cited

U.S. PATENT DOCUMENTS 4,843,275 A * 6/1989 Radice ..... 310/334

6,321,428 B1 * 11/2001 Toda et al. ..... 29/25.35

FOREIGN PATENT DOCUMENTS

JP 55-73199 6/1980
JP 2001-524278 11/2001

OTHER PUBLICATIONS

U.S. Appl. No. 11/482,789, filed Jul. 10, 2006, Ohashi, et al.

* cited by examiner

*Primary Examiner*—Huyen D Le
(74) *Attorney, Agent, or Firm*—Oblon, Spivak, McClelland, Maier & Neustadt, L.L.P.

(57) ABSTRACT

An electroacoustic transducer has a cup chamber and a diaphragm made of deformable electrostrictive polymer, which is attached to an opening of the chamber. The electroacoustic transducer also has first and second adaptive electrode layers formed on a front surface and a rear surface of the diaphragm, across which audio signal voltage biased by a direct-current biased voltage is applied. The first and second adaptive electrode layers have shapes that are adjustable according to a change in a shape of the diaphragm. To form the diaphragm, the electrostrictive polymer that has been previously formed to have a concave or convex shape is further formed to have a concave or convex shape, thereby generating a difference in air pressure between the front surface and the rear surface of the previously formed electrostrictive polymer.

5 Claims, 7 Drawing Sheets

ELECTROACOUSTIC TRANSDUCER USING DIAPHRAGM AND METHOD FOR PRODUCING DIAPHRAGM

CROSS REFERENCE TO RELATED APPLICATION

The present invention contains subject matter related to Japanese Patent Application JP 2005-210251 filed in the Japanese Patent Office on Jul. 20, 2005, the entire contents of which being incorporated herein by reference.

BACKGROUND OF THE INVENTION

1. Field of the Invention

The present invention relates to an electroacoustic transducer such as a speaker using a diaphragm made of deformable electrostrictive polymer and a method for producing the diaphragm used in the electroacoustic transducer.

2. Description of Related Art

Proposed has been an electroacoustic transducer having a diaphragm and an electrode layers across which an audio signal voltage biased by a direct-current biased voltage is applied, that are placed on a front surface and a rear surface of the diaphragm. The electroacoustic transducer has used a difference in air pressure of the front surface and the rear surface of the diaphragm to form the concave or convex diaphragm so that it can convert any deformation of the diaphragm on its surface direction into any vibration in a thickness direction of the diaphragm, thereby emitting an audio signal. For example, the Japanese Patent Application Publication No. S55-73199 has disclosed the electroacoustic transducer in which a diaphragm made of polyvinylidene fluoride as piezoelectric polymer has been used. Further, International Application No. PCT/US98/02311 (International Publication No. WO 98/3529) has disclosed a sonic actuator in which a diaphragm made of elastomeric dielectric polymer has been used.

SUMMARY OF THE INVENTION

In order to use the diaphragms disclosed in the above publications as efficient diaphragms for emitting an audio signal, it is very significant to make a thickness of the whole diaphragm even. The above publications, however, has disclosed no variation in a thickness of any parts of the diaphragm. Further, if the diaphragm has uneven thickness, electric field strength applied to any parts of the diaphragm may vary in a large way, thereby emitting an audio signal inefficiently.

It is desirable to provide an electroacoustic transducer using a diaphragm, a whole of which can emit the audio signal efficiently, and the like.

According to an embodiment of the invention, there is provided an electroacoustic transducer having a cup chamber, a diaphragm made of deformable electrostrictive polymer, which is attached to an opening of the chamber, and first and second adaptive electrode layers formed on a front surface and a rear surface of the diaphragm, across which audio signal voltage biased by a direct-current biased voltage is applied. These first and second adaptive electrode layers have shapes that are adjustable according to a change in the shape of the diaphragm. To form the diaphragm, the electrostrictive polymer that has been previously formed to have a concave or convex shape is further formed to have a concave or convex shape, thereby to generate a difference in air pressure between the front surface and the rear surface of the previously formed electrostrictive polymer.

On the embodiment of the invention, the diaphragm made of deformable electrostrictive polymer is attached to an opening of the cup chamber. The first and second adaptive electrode layers having shapes that are adjustable according to a change in the shape of the diaphragm are formed on a front surface and a rear surface of the diaphragm. This diaphragm is formed so that the electrostrictive polymer that has been previously formed to have a concave or convex shape can be further formed to have a concave or convex shape, thereby to generate a difference in air pressure between the front surface and the rear surface of the previously formed electrostrictive polymer.

When forming the electroacoustic transducer, after the diaphragm made of deformable electrostrictive polymer, which has been previously formed to have a concave or convex shape, has been attached to an opening of the cup chamber, gas is supplied into the chamber or exhausted from the chamber so that the electrostrictive polymer can be further formed to have a concave or convex shape, thereby to generate a difference in air pressure between the front surface and the rear surface of the previously formed electrostrictive polymer, to form the diaphragm.

The audio signal voltage biased by a direct-current biased voltage is applied across the first and second adaptive electrode layers. This enables the diaphragm to convert any deformation on its surface direction to any vibration on its thickness direction conforming to an audio signal, thereby emitting the audio signal from the diaphragm. In this case, since the diaphragm is further formed to have a concave or convex shape so that a difference in air pressure can be generated between the front surface and the rear surface of the previously formed electrostrictive polymer to have a concave or convex shape, variation in a thickness of any parts of the diaphragm can be restrained. Variation in electric field strength applied to any parts of the diaphragm is also restrained, thereby allowing the whole diaphragm to emit the audio signal efficiently.

Thus, according to the embodiment of the invention, the diaphragm made of deformable electrostrictive polymer, which is attached to an opening of the cup chamber, is formed to have a concave or convex shape by further forming the electrostrictive polymer that has been previously formed to have a concave or convex shape so that a difference in air pressure can be generated between the front surface and the rear surface of the previously formed electrostrictive polymer. This allows variation in a thickness of any parts of the diaphragm to be restrained and variation in electric field strength applied to any parts of the diaphragm to be also restrained, thereby allowing the whole diaphragm to emit an audio signal efficiently.

The concluding portion of this specification particularly points out and directly claims the subject matter of the present invention. However, those skilled in the art will best understand both the organization and method of operation of the invention, together with further advantages and objects thereof, by reading the remaining portions of the specification in view of the accompanying drawing(s) wherein like reference characters refer to like elements.

DESCRIPTION OF THE PREFERRED EMBODIMENT

Figure 1:
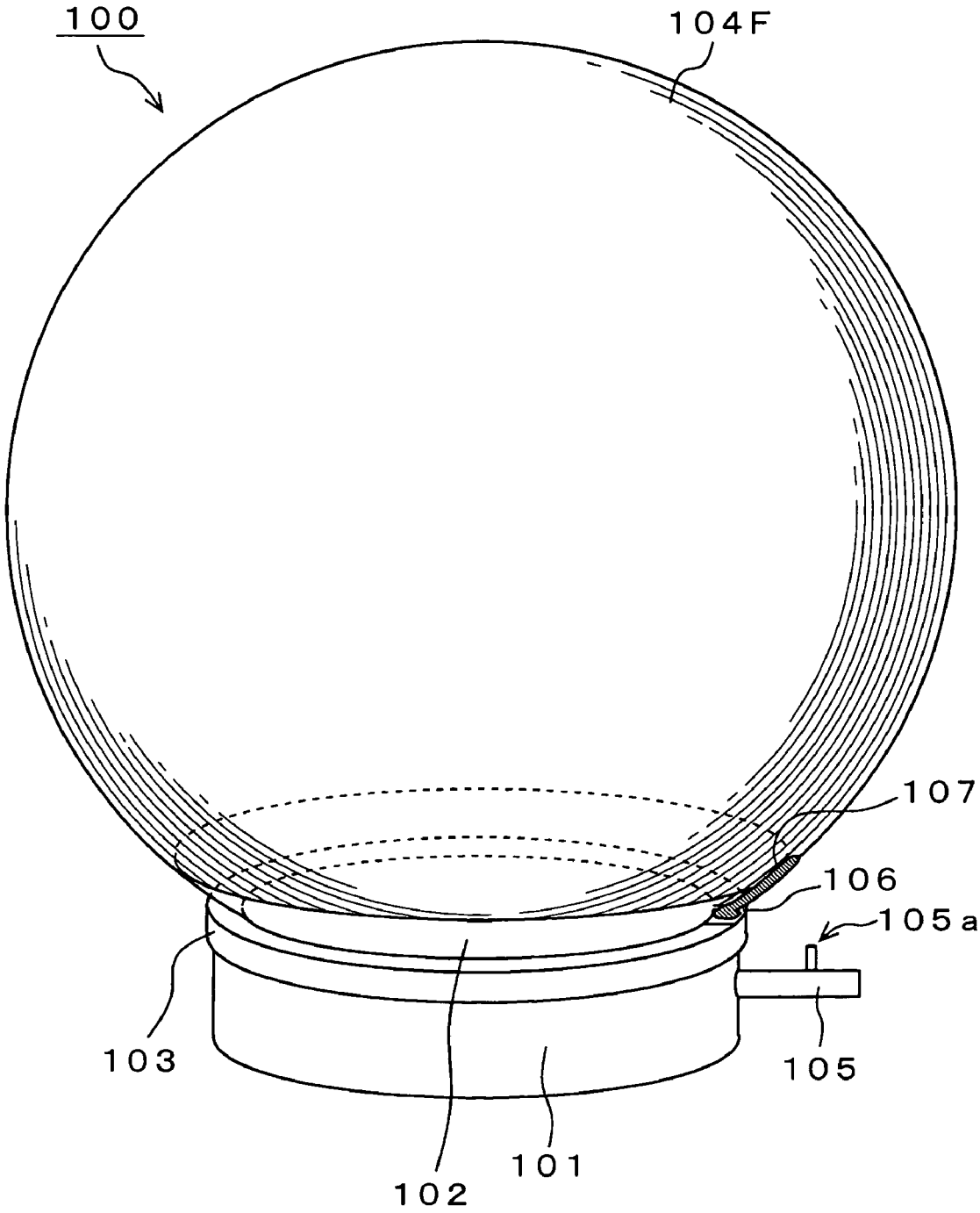
FIG. 1 is a perspective view of an electroacoustic transducer for showing a configuration of thereof according to an embodiment of the invention.
Figure 2:
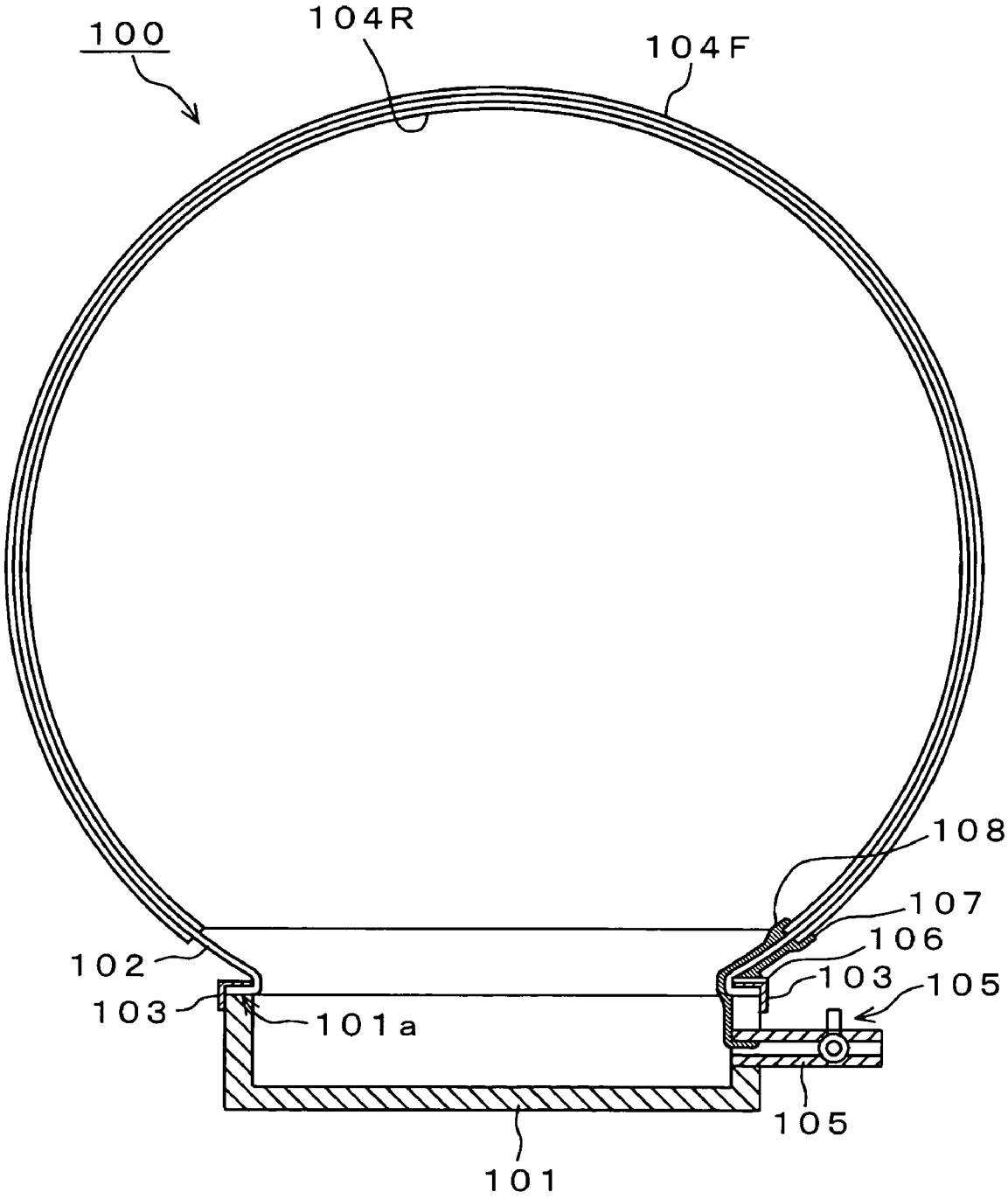
FIG. 2 is a cross-sectional view of the electroacoustic transducer for showing a configuration of thereof according to the embodiment of the invention.

The following will describe an electroacoustic transducer according to a preferred embodiment of the present invention with reference to drawings. FIG. 1 shows a configuration of the electroacoustic transducer 100 according to an embodiment of the invention. FIG. 2 is a cross-sectional view thereof.

In the electroacoustic transducer 100, the diaphragm 102 made of deformable electrostrictive polymer is attached to an opening end 101*a* of the cup chamber 101. In this case, a ring-shaped retainer 103 retains an end portion of the diaphragm 102 on the opening end 101*a* of the cup chamber 101. Thus, retaining the diaphragm 102 on the opening end 101*a* of the cup chamber 101 enables any enclosed space to be formed within the chamber 101.

It is to be noted that an end portion of the diaphragm 102 may be adhered to the opening end 101*a* of the cup chamber 101 by any adhesives without using the retainer 103. The chamber 101 and the retainer 103 are made of non-conductive material, for example, synthetic resin.

To a front surface and a rear surface of the diaphragm 102, an adaptive electrode layer 104F and an adaptive electrode layer 104R are respectively applied and formed. Across these adaptive electrode layers 104F, 104R, audio signal voltage biased by a direct-current biased voltage is applied. These adaptive electrode layers 104F, 104R respectively refer to as electrode layers having shapes that are adjustable to a change in the shape of the diaphragm 102. As these adaptive electrode layers 104F, 104R, conductive silicon RTV rubber X-31-2060 manufactured by SHINETSU CHEMICAL KOGYO K.K., Japan, for example, can be used.

The following will describe formation of the diaphragm 102.

Figure 3:
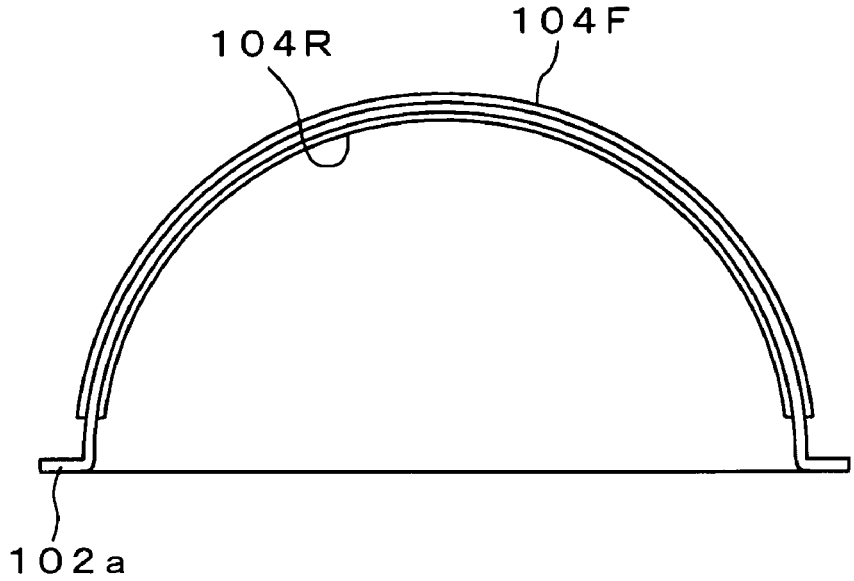
FIG. 3 is a cross-sectional view of the diaphragm for showing an initial state thereof.

As shown in FIG. 3, a diaphragm 102*a* (hereinafter referred to as "diaphragm 102*a* of initial state" timely) made of deformable electrostrictive polymer, which has been previously formed to have a convex shape, is attached to an opening 101*a* of the chamber 101 by using the retainer 103 as described above.

The electrostrictive polymer is molded by using any molding system such as a compression molding, a vacuum molding, a press molding, and an injection molding so that the diaphragm 102*a* of initial state can be obtained. As the deformable electrostrictive polymer, "hyper-gel sheet" of hardness 15 manufactured by Exseal Corporation, Gifu, Japan, for example, can be used. To a front surface and a rear surface of the diaphragm 102*a* of initial state thus molded, the adaptive electrode layers 104F, 104R are applied and formed (see FIG. 3) and then the diaphragm 102*a* of initial state is attached to the opening 101*a* of the chamber 101, as described above.

It is to be noted that a port 105 is provided on a position of a side wall of the chamber 101 to supply gas into the chamber 101 or exhaust gas from the chamber 101. The port 105 is made of metallic pipe and provided with open/close device (cock mechanism) 105*a*.

To the port 105, a gas-supplying device, for example, a air compressor, not shown, is attached to supply gas into the chamber 101 with the open/close device 105*a* being set to its open position. In a situation just before the gas has been supplied into the chamber 101, there is no difference in air pressure between the inside and the outside of the chamber 101, namely, a front surface and a rear surface of the diaphragm 102*a*.

Figure 4:
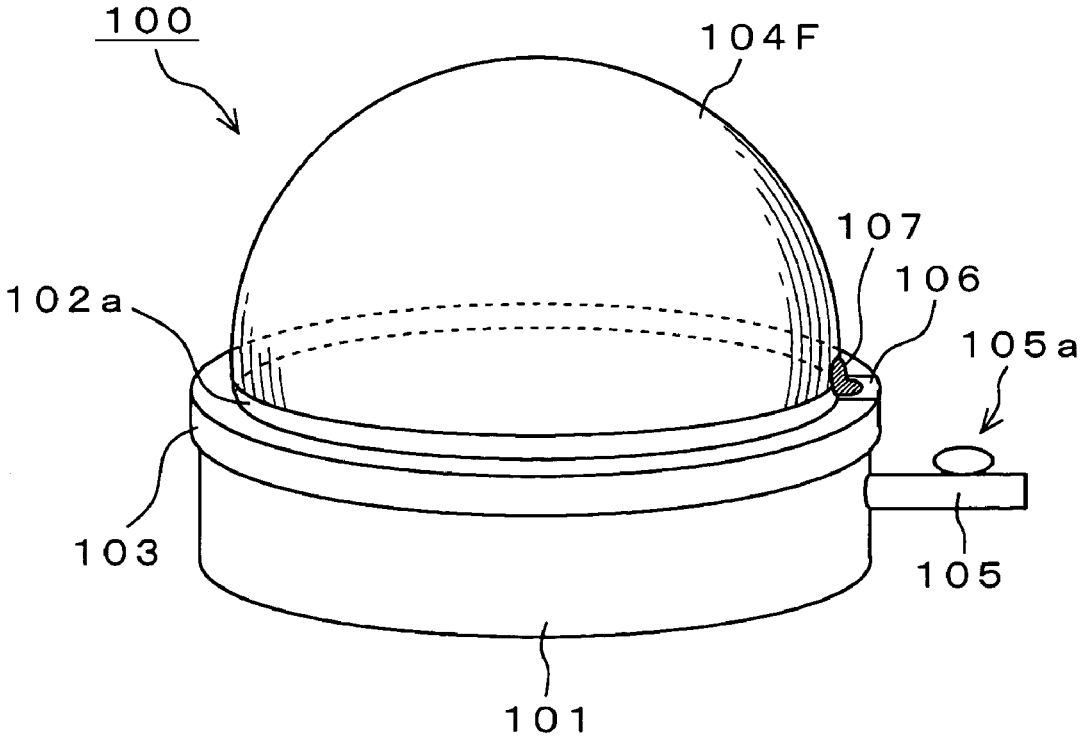
FIG. 4 is a perspective view of the electroacoustic transducer according to the embodiment of the invention for showing the initial state thereof before the diaphragm has been finally formed.
Figure 5:
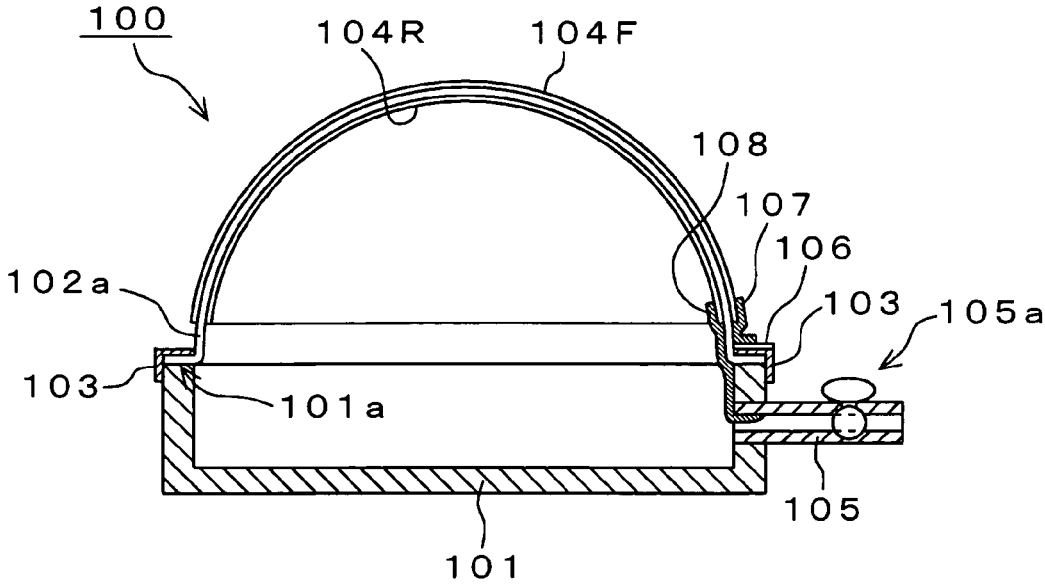
FIG. 5 is a cross-sectional view of the electroacoustic transducer according to the embodiment of the invention for showing the initial state thereof before the diaphragm has been finally formed.

FIG. 4 is a perspective view of the electroacoustic transducer 100 for showing an initial state thereof where the diaphragm 102*a* is attached to the opening 101*a* of the chamber 101. FIG. 5 is a cross-sectional view of the electroacoustic transducer 100 for showing the initial state thereof where the diaphragm 102*a* is attached to the opening 101*a* of the chamber 101. It is to be noted that FIGS. 4, 5 show states where the open/close device 105*a* is set to its open position. On the other hands, FIGS. 1, 2 show states where the open/close device 105*a* is set to its close position.

Next, gas is supplied into the chamber 101 to generate difference in air pressure between the front surface and the rear surface of the diaphragm 102*a*, thereby further forming the diaphragm 102*a* to obtain the diaphragm 102 finally.

In other words, on the initial state thereof, the air compressor, for example, supplies gas such as air into the chamber 101. Air pressure in the chamber 101 is increased by degrees and the diaphragm 102 fills out accompanying it to become convex still more. When a radius of the diaphragm 102*a* is reached to a predetermined value, for example, twice that of the initial state thereof, the air compressor stops supplying the air into the chamber 101, thereby obtaining the diaphragm 102 finally.

It is to be noted that in this state, the open/close device 105*a* of the port 105 is closed (see FIGS. 1 and 2), thereby maintaining a formed shape of the diaphragm 102.

As described above, the audio signal voltage biased by a direct-current biased voltage is applied across these adaptive electrode layers 104F, 104R, which are respectively formed on the front surface and the rear surface of the diaphragm 102.

A metallic terminal plate 106 for configuring a terminal on which the audio signal voltage is applied is arranged on a part of the retainer 103. This terminal plate 106 is electrically connected to the adaptive electrode layer 104F formed on the front surface of the diaphragm 102 via conductive paste 107.

Further, the port 105 is electrically connected to the adaptive electrode layer 104R formed on the rear surface of the diaphragm 102 via conductive paste 108. This port 105 is used as a terminal on which the audio signal voltage is applied.

The above-mentioned audio signal voltage biased by a direct-current biased voltage is applied across the terminal plate 106 and the port 105, so that the audio signal voltage can be applied across these adaptive electrode layers 104F, 104R.

Figure 6:
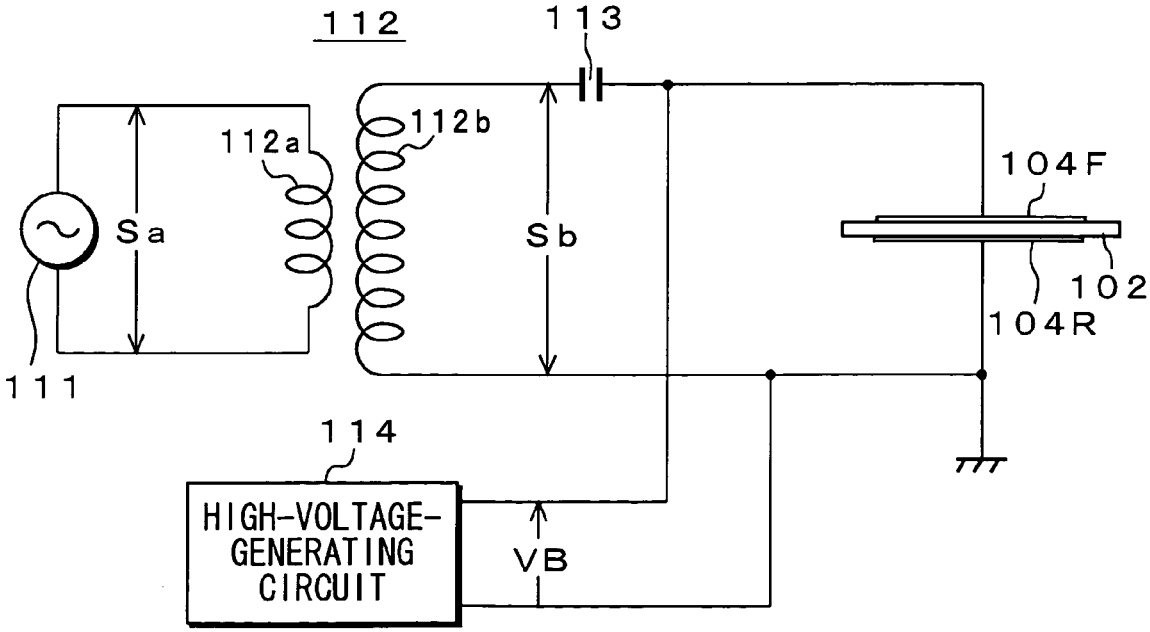
FIG. 6 is a circuit diagram for showing a configuration of a driving circuit in the electroacoustic transducer.

FIG. 6 shows a configuration of a driving circuit in the electroacoustic transducer 100. A primary coil 112*a* of a step-up transformer 112 receives the audio signal Sa from an audio signal source 111. This allows a secondary coil 112*b* of the step-up transformer 112 to obtain a boosted audio signal Sb. An end of the secondary coil 112*b* of the step-up transformer 112 directly connects the adaptive electrode layer 104R that is grounded. The other end of the secondary coil 112*b* of the step-up transformer 112 connects the adaptive electrode layer 104F through a capacitor 113 for cutting a direct current.

A high-voltage-generating circuit 114 generates direct-current biased high-voltage VB. A negative side of this high-voltage-generating circuit 114 connects the adaptive electrode layer 104R. A positive side thereof connects the adaptive electrode layer 104F. This causes the audio signal Sb biased by the direct-current biased high-voltage VB to be applied across these adaptive electrode layers 104F, 104R.

Figure 7:
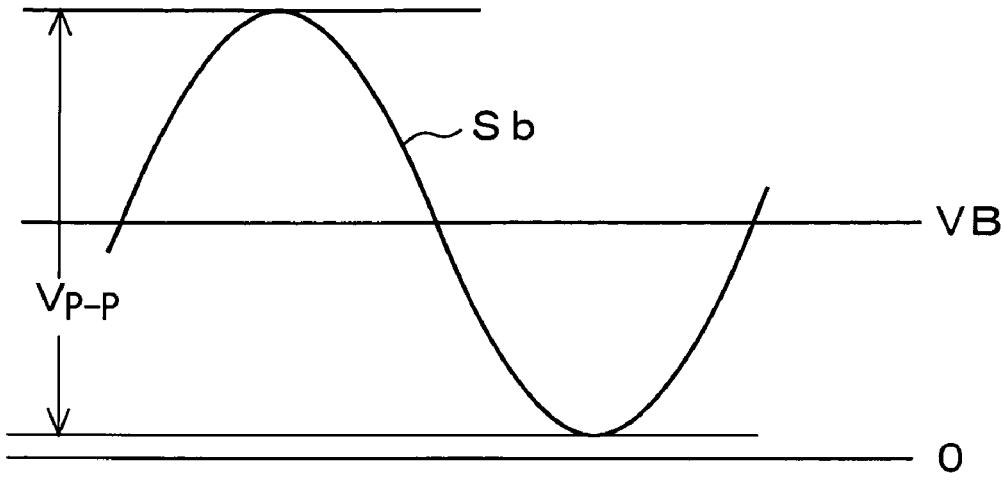
FIG. 7 is a graph for showing relationship between a level of direct-current biased voltage and a boosted audio signal in the driving circuit.

FIG. 7 shows a relationship between a level of the direct-current biased high-voltage VB and the boosted audio signal Sb. The direct-current biased high-voltage VB is set so that it can exceed at least a half of a peak-to-peak value Vp-p of the boosted audio signal Sb. For example, when the peak-to-peak value Vp-p of the boosted audio signal Sb is 4 kV, the direct-current biased high-voltage VB is set to become 2 kV.

The following will describe operations of the electroacoustic transducer 100 shown in FIGS. 1 and 2. The boosted audio signal Sb biased by the direct-current biased high-voltage VB is applied across these adaptive electrode layers 104F, 104R respectively formed on the front surface and the rear surface of the diaphragm 102 through the terminal plate 106 and the port 105.

The diaphragm 102 is made of the deformable electrostrictive polymer as described above so that, if voltage is applied across these adaptive electrode layers 104F, 104R, any attraction (Coulomb attraction) occurs between these adaptive electrode layers 104F, 104R, thereby decreasing a thickness of the diaphragm 102 to obtain an enlarged area thereof on its surface direction.

Since the diaphragm 102 obtains an enlarged area thereof on its surface direction by the direct-current biased high-voltage VB when the boosted audio signal Sb biased by the direct-current biased high-voltage VB is applied across these adaptive electrode layers 104F, 104R as described above, the diaphragm 102 is deformed based on a change in a level of the boosted audio signal Sb.

Since in this moment, the diaphragm 102 is formed to generate a difference in air pressure between the front surface and the rear surface of the diaphragm 102 so that the diaphragm 102 can be formed convex, as described above, the diaphragm 102 is deformed on its surface direction, thereby altering cubic capacity in a closed container constituted of the chamber 101 and the diaphragm 102 based on the difference in air pressure therein. This allows the diaphragm 102 to vibrate on its thickness direction based on a change in a level of the audio signal Sb. Thus, electric energy of the audio signal Sb is converted into acoustic energy so that the diaphragm 102 can emit an audio signal.

According to the above-mentioned electroacoustic transducer 100 shown in FIGS. 1 and 2, the diaphragm 102*a* of initial state made of deformable electrostrictive polymer that has been previously formed to have a convex shape is attached to an opening 101*a* of the chamber 101 by using the retainer 103 and then, the diaphragm 102*a* of initial state is further formed to have a convex shape still more, thereby generating difference in air pressure between the front surface and the rear surface of the diaphragm 102*a* to obtain the diaphragm 102 finally. This restrains variation in thickness at any parts of the diaphragm 102.

Figure 8:
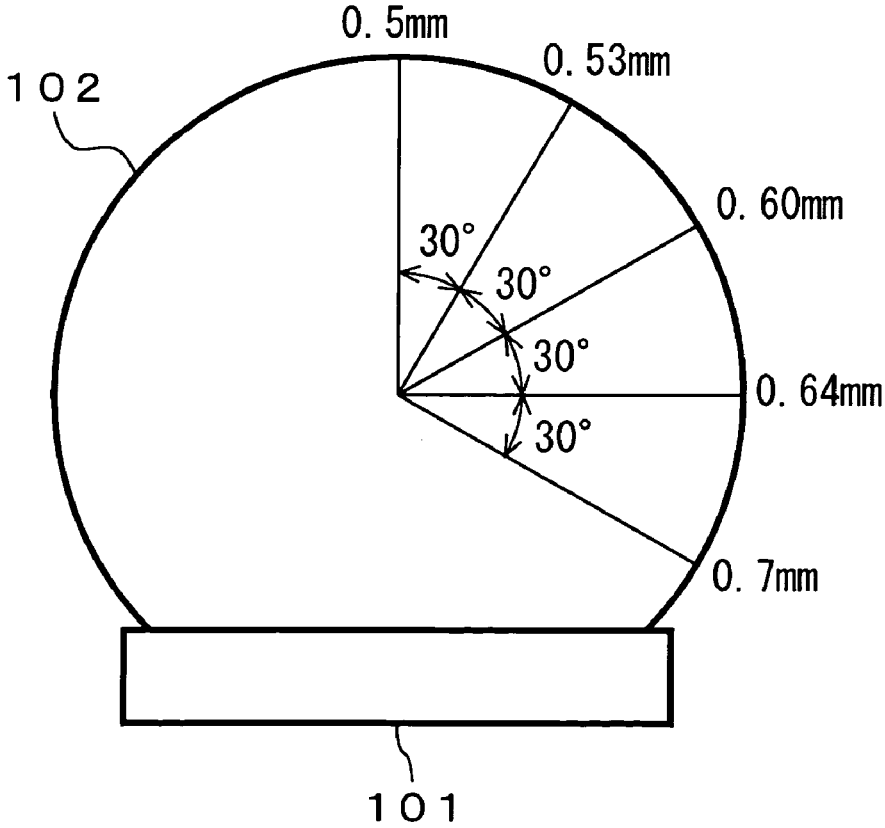
FIG. 8 is a rough illustration of the diaphragm for showing a distribution of variation in thickness of the diaphragm.

For example, as the deformable electrostrictive polymer, "hyper-gel sheet" of hardness 15 manufactured by Exseal Corporation, Gifu, Japan having a thickness of 1 mm was used and the deformable electrostrictive polymer was molded under a temperature of 120° C. by means of press molding to form the diaphragm 102*a* of initial state having a radius of 50 mm. The diaphragm 102*a* indicated its thickness within a range thereof from 0.8 mm to 1 mm. The diaphragm 102*a* of initial state was then attached to the opening 101*a* (its radius of 100 mm) of the chamber 101 and air was supplied into the chamber 101 to inflate it, thereby obtaining the diaphragm 102 having a convex shape and a radius of 100 mm finally. This diaphragm 102 indicated its thickness distribution within a variation thereof as shown in FIG. 8, i. e., from 0.5 mm to 0.7 mm. A ratio of minimum thickness to maximum thickness was 0.5/0.7=0.714, which indicated less variation in thickness at any parts of the diaphragm 102.

Figure 9:
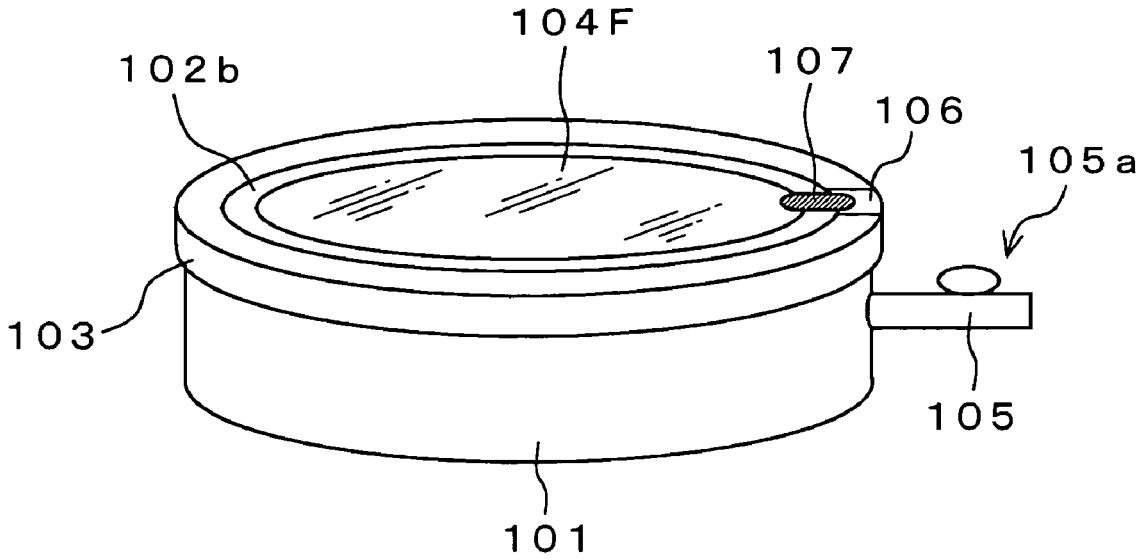
FIG. 9 is a perspective view of an electroacoustic transducer as a comparison example for showing an initial state of this electroacoustic transducer.
Figure 10:
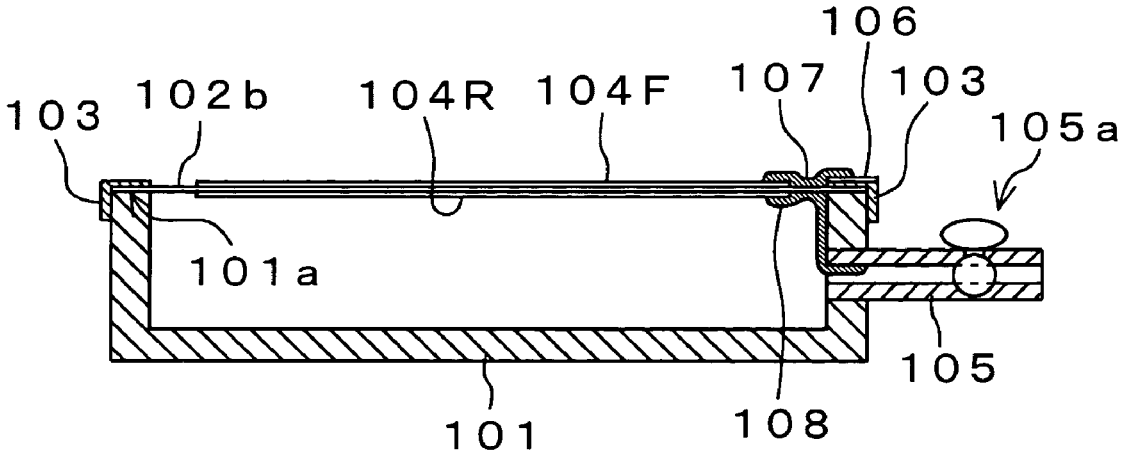
FIG. 10 is a cross-sectional view of the electroacoustic transducer as a comparison example for showing the initial state thereof.
Figure 11:
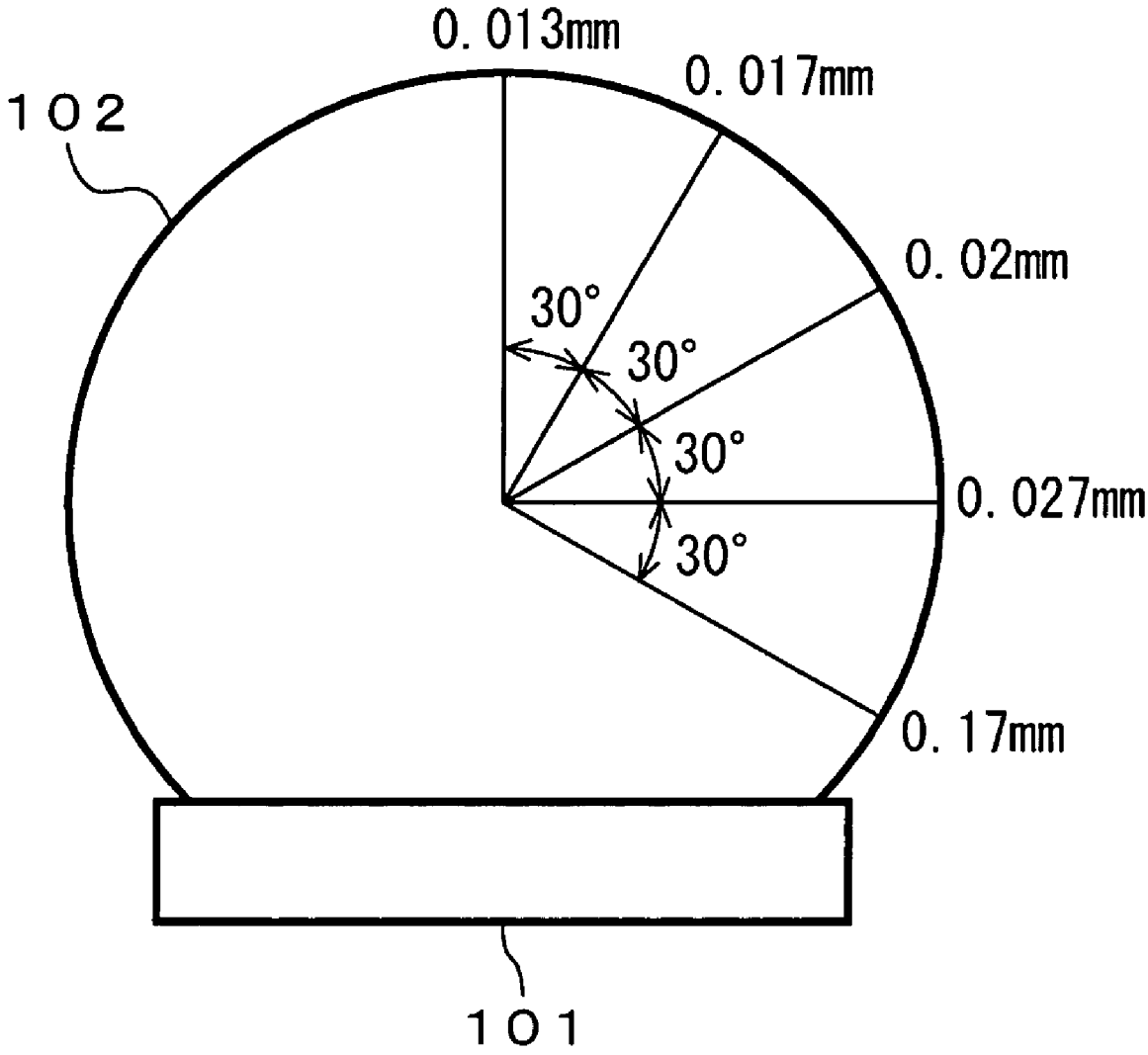
FIG. 11 is a rough illustration of the diaphragm as a comparison example for showing a distribution of variation in thickness of the diaphragm.

On the other hands, as a comparison example, the deformable electrostrictive polymer, "hyper-gel sheet" of hardness 15 manufactured by Exseal Corporation, Gifu, Japan having a thickness of 1 mm was used and the deformable electrostrictive polymer was flat and not molded to have a convex shape, as shown in FIGS. 9 and 10. The diaphragm 102*b* is attached to an opening 101*a* of the chamber 101 and air is supplied into the chamber to inflate it, thereby obtaining the diaphragm 102 (as shown in FIGS. 1 and 2) having a convex shape and a radius of 100 mm finally. This diaphragm 102 indicated its thickness distribution within a variation range thereof as shown in FIG. 11, i. e., from 0.013 mm to 0.17 mm. A ratio of minimum thickness to maximum thickness was 0.013/0.17=0.076, which indicated relatively large variation in thickness at any parts of the diaphragm 102.

In FIGS. 9 and 10, like reference characters refer to like elements shown in FIGS. 4 and 5, a detailed explanation of which will be omitted.

Thus, according to the above-mentioned electroacoustic transducer 100 shown in FIGS. 1 and 2, variation in a thickness of any parts of the diaphragm is restrained and thus, variation in electric field strength applied to any parts of the diaphragm is also restrained. This allows the whole diaphragm to emit an audio signal efficiently.

Although in the above embodiment, the deformable electrostrictive polymer has been previously molded to have a convex shape and the molded electrostrictive polymer has been further formed to generate difference in air pressure between the front surface and the rear surface of the diaphragm 102 to obtain the diaphragm 102, the deformable electrostrictive polymer can have been previously molded to have a concave shape and the molded electrostrictive polymer can have been further formed to generate difference in air pressure between the front surface and the rear surface of the diaphragm 102 to obtain the diaphragm 102. In this case, the deformable electrostrictive polymer that has been previously molded to have a concave shape is attached to the opening 101*a* of the chamber 101 and air is exhausted from the chamber via the port 105. In this case, air pressure in the chamber 101 is decreased by degrees and the diaphragm 102 sinks accompanying it to become concave, thereby obtaining a diaphragm further formed to have a concave shape.

Even if forming the diaphragm to have a concave shape, variation in a thickness of any parts of the diaphragm is restrained. This enables the same effect as that of a case where the diaphragm 102 is formed to have a convex shape to be attained.

Although in the above embodiment, the port 105 has been provided with the open/close device (cock mechanism) 105*a*, the port 105 can be provided with no open/close device. In this case, an opening of each of the ports 105, 106 is sealed with any sealing compounds or melted under a situation where air is supplied into the chamber 101 and the diaphragm 102 is molded so that a difference in air pressure of the front surface and the rear surface of the diaphragm 102 can be generated, thereby maintaining its enclosed condition.

The electroacoustic transducer according to embodiment of the present invention can emit the audio signal efficiently by its whole diaphragm and thus, is applied to an electroacoustic transducer such as a speaker itself and a speaker added to any acoustic device. It should be understood by those skilled in the art that various modifications, combinations, sub-combinations and alternations may occur depending on design requirements and other factors insofar as they are within the scope of the appended claims or the equivalents thereof.

What is claimed is:

1. An electroacoustic transducer comprising:

a cup chamber;

a diaphragm made of deformable electrostrictive polymer, said diaphragm being attached to an opening of the chamber; and first and second adaptive electrode layers formed on a front surface and a rear surface of the diaphragm, across which audio signal voltage biased by a direct-current biased voltage is applied, said first and second adaptive electrode layers having shapes that are adjustable according to a change in a shape of the diaphragm, the diaphragm formed from the electrostrictive polymer having any one of concave and convex shapes, and the diaphragm further formed to have any one of concave and convex shapes thereof by generating a difference in air pressure between the front surface and the rear surface of the previously formed electrostrictive polymer such that has a ratio of a minimum thickness of the diaphragm to a maximum thickness of the diaphragm is not less than 5/7.

2. A method for producing a diaphragm used in an electroacoustic transducer, the electroacoustic transducer having:

a cup chamber;

a diaphragm made of deformable electrostrictive polymer, said diaphragm being attached to an opening of the chamber; and first and second adaptive electrode layers formed on a front surface and a rear surface of the diaphragm, across which audio signal voltage biased by a direct-current biased voltage is applied, said first and second adaptive electrode layers having shapes that are adjustable according to a change in a shape of the diaphragm, said method comprising:

attaching the diaphragm made of deformable electrostrictive polymer to an opening of the chamber, said electrostrictive polymer having any one of concave and convex shapes such that the diaphragm is not flat; and performing any one of supplying gas into the chamber and exhausting gas from the chamber to further deform the diaphragm having any one of concave and convex shapes thereof such that a radius of the diaphragm after the performing is different from a radius of the diaphragm before the performing, thereby to generate a difference in air pressure between the front surface and the rear surface of the previously formed electrostrictive polymer.

3. The method according to claim 2, wherein the radius of the diaphragm after performing is greater than the radius of the diaphragm before the performing.

4. The method according to claim 2, wherein a ratio of a minimum thickness of the diaphragm to a maximum thickness of the diaphragm is not less than 5/7 after the performing.

5. The method according to claim 2, wherein the diaphragm has a semicircular shape before the performing.

* * * * *